United States Patent [19]

Miller

[11] Patent Number: 4,471,528

[45] Date of Patent: Sep. 18, 1984

[54] TUFTING BUTTON UPHOLSTERY MACHINE

[76] Inventor: Richard M. Miller, 3067 Seaview Ave., Ventura, Calif. 93001

[21] Appl. No.: 447,292

[22] Filed: Dec. 6, 1982

[51] Int. Cl.[3] ..... B68G 7/08

[52] U.S. Cl. ..... 29/91.2; 29/91.4; 198/657; 198/475

[58] Field of Search ..... 29/91.2, 91.3, 91.4, 29/91.8, 809; 198/657, 475, 680; 221/75; 112/21, 22, 108; 227/104

[56] References Cited

U.S. PATENT DOCUMENTS

| | | | |
|---|---|---|---|
| 373,330 | 11/1887 | Bennett | 112/108 X |
| 537,688 | 4/1895 | Kistner | 29/91.3 |
| 652,220 | 6/1900 | Phelps | 112/108 |
| 661,302 | 11/1900 | Bernhardt et al. | 29/91.4 |
| 776,055 | 11/1904 | Grosjean et al. | 29/91.3 |
| 916,120 | 3/1909 | Dickson | 29/91.4 |
| 1,083,907 | 1/1914 | Anderson | 112/108 |
| 1,220,237 | 3/1917 | Kenyon | 29/91.3 |
| 4,018,359 | 4/1977 | Lambert | 221/75 X |
| 4,059,889 | 11/1977 | Randolph et al. | 29/809 X |
| 4,061,245 | 12/1977 | Lotspeich | 221/75 |
| 4,185,367 | 1/1980 | Puchy | 29/91.4 X |
| 4,312,471 | 1/1982 | Randolph | 29/809 X |
| 4,368,566 | 1/1983 | Miller | 29/91.4 |

*Primary Examiner*—Carl E. Hall
*Assistant Examiner*—John T. Burtch
*Attorney, Agent, or Firm*—Jack C. Munro

[57] ABSTRACT

An upholstery machine for the tufting of buttons within cushions wherein a needle picks up a string loop which is attached to a lower button and is then caused to penetrate the cushion. The needle is withdrawn and the string loop secured to an upper button. A button feeding mechanism is utilized which comprises an enlarged, elongated coil spring. The coil spring supports a single lower button with its attached loop of string at each coil of the spring thereby forming a row of the button assemblies. The inner end of the coil spring is attached to a power source which is to incrementally rotate the coil spring to discharge a single button assembly from the free outer end of the coil spring at a selected instant. The discharged button assembly is to be engaged with the needle. The power source includes appropriate gearing mechanism to reverse rotation of the coil spring to facilitate the loading of the coil spring with the button assemblies.

30 Claims, 13 Drawing Figures

TUFTING BUTTON UPHOLSTERY MACHINE

REFERENCE TO PRIOR APPLICATION

The subject matter of this invention is an improvement of the structure defined and claimed within U.S. patent application Ser. No. 176,460, filed Aug. 8, 1980, entitled UPHOLSTERY MACHINE, by the present inventor.

BACKGROUND OF THE INVENTION

The field of this invention relates to an upholstery machine and more particularly to an upholstery machine which is usable for the tufting of buttons within cushions, and still more particularly to a particular novel structure of button feeding mechanism to be utilized in combination with an upholstery machine.

The typical cushion comprises a resilient pad which is covered by either fabric, vinyl or leather. In order to give the cushion an attractive exterior appearance, the cushion may have a plurality of spaced-apart buttons tufted into the exterior surface of the cushion.

The normal procedure prior to this invention for the tufting of buttons (except for the above-referenced prior patent application) has been manual. The button assembly takes the form of a lower button and an upper button which are usually identical. The lower button has attached thereto a string loop. The length of the string loop is selected to be a certain length less than the thickness of the cushion. The string loop is connected to a slot and an elongated needle. The operator then passes the needle through the cushion at the desired location. The operator pulls the string loop tight until the bottom button is pushed tightly against the bottom surface of the cushion. The operator continues to hold the string loop tight and then compresses the top surface of the cushion about the area of the string loop. The operator takes a top button and attaches it to the taut string loop while maintaining compression of the top surface of the cushion about the area of the string loop. The operator takes a top button and attaches it to the string loop and then manually releases the needle. The operator then releases the cushion which permits the cushion to expand back to its uncompressed, normal state which results in the top button being pushed tightly against the top surface of the cushion.

It is not at all unusual for a typical cushion to have as many ten, fifteen or twenty button assemblies. This manual procedure for the attaching of buttons is extremely time consuming and as a result, is labor expensive.

The machine of the above-referenced patent application semi-automated the tufting of buttons within cushions, thereby substantially decreasing the time required for such. However, the present inventor has found a way to simplify the structure of the machine of the above-referenced patent application and minimize the operating steps involved for the tufting of buttons, using an upholstery machine which is similar in construction to the machine of the above-referenced patent application.

SUMMARY OF THE INVENTION

The upholstery machine of the present invention is designed for the tufting of buttons within cushions. A cushion is to be located on an operating table. A ring is to be moved downwardly onto the cushion compressing a portion of the cushion. A loop of string, which is attached to a bottom (or lower) button, is discharged from the free (or outer) end of an enlarged, elongated coil spring by the coil spring being rotated a single three hundred and sixty degree cycle. The discharged lower button assembly is dropped onto an extended arm assembly. The arm assembly is now retracted which causes the string to engage with a slot a needle. The needle is then moved through the cushion and protrudes from the upper side of the cushion and carries with it the loop of string. The needle has penetrated the cushion centrally disposed within the ring. The needle is then retracted from the cushion and a top button is manually attached to the loop of string which is now protruding from the upper surface of the cushion. The ring is then retracted resulting in the cushion re-expanding thereby making taut the loop of string between the bottom and top buttons. The coil spring is driven through a gear assembly which includes an idler gear which can be located in two different positions. With the idler gear located in one position, the coil spring is driven clockwise and with the idler gear located in the other direction, the coil spring is driven in the reverse direction or counterclockwise.

The primary objective of this invention is to construct an upholstery machine which tufts buttons within cushions much faster than such installation can be accomplished manually.

Another objective of this invention is to construct an upholstery machine which simplifies the operating steps and also simplifies the structure of the machine to thereby diminish manufacturing costs of the machine when compared to the upholstery machine of the above-referenced patent application.

DETAILED DESCRIPTION OF THE SHOWN EMBODIMENT

Referring particularly to the drawings, there is shown the upholstery machine 20 of this invention which is constructed generally in the form of a table section 22. There is an upright stanchion section (not shown) which is mounted on the table section 22. Extending from the upright stanchion section is a compression ring 24. The compression ring 24 will be described further on in the specification.

Figure 13:
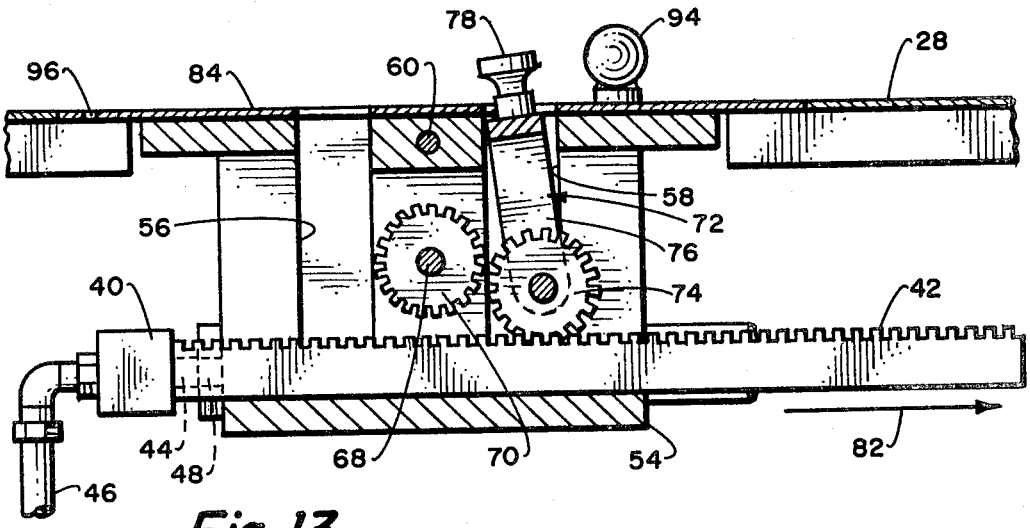
FIG. 13 is a view similar to FIG. 12 but showing the idler gear physically located at a different location in order to achieve reverse rotation of the enlarged coil spring.

Table section 22 includes an enlarged cut-out opening 26 which is formed within the plate 28 which forms the table surface for the table section 22. Within the opening 26 is mounted a housing 30 which is basically in the shape of a frame defining interiorly an internal chamber 32. Within the aft end of the internal chamber 32 there is located a flange 34 which is attached to the housing 30. An acutator 36 is fixedly mounted to the flange 34. A hole (not shown) is provided through the flange 34 through which extends actuator rod 38. The actuator 36 is to include a piston assembly (not shown) which is to be movable from a valve source of pressurized gas (not shown). As a result, the rod 38 is to be movable lineally from an extended position shown in FIG. 11 of the drawings to a retracted position, as shown in FIG. 13 of the drawings. The outer end of the rod 38 is connected to a block 40. The block 40 has attached thereto a rack gear 42. Also mounted within the block 40 is a switch 44. The switch 44 connects to a conduit 46. Retracted movement of the rack gear 42 will result in the switch 44 coming into contact with protuberance 48. This will activate the switch 44 which, through conduit 46, will apply gas pressure to the opposite side of the piston within the actuator 36, which will result in the rack gear 42 being moved back to its extended position shown in FIG. 11 of the drawings.

The protuberance 48 is mounted on gear housing 50. The gear housing 50 is fixedly mounted to the flange 34. The rack gear 42 passes through elongated chamber 52 of the gear housing 50. The rack gear 42 rides upon bottom plate 54 which is formed as part of the gear housing 50.

Located within the gear housing 50 are two spaced-apart, generally vertically disposed compartments 56 and 58. It is to be understood that throughout this patent application, that vertically disposed implies that the longitudinal center axis of the referred to structure is generally in alignment with gravity. Horizontal is to imply generally transverse to the direction of gravity. Each of the compartments 56 and 58 connect with elongated chamber 52.

Figure 11:
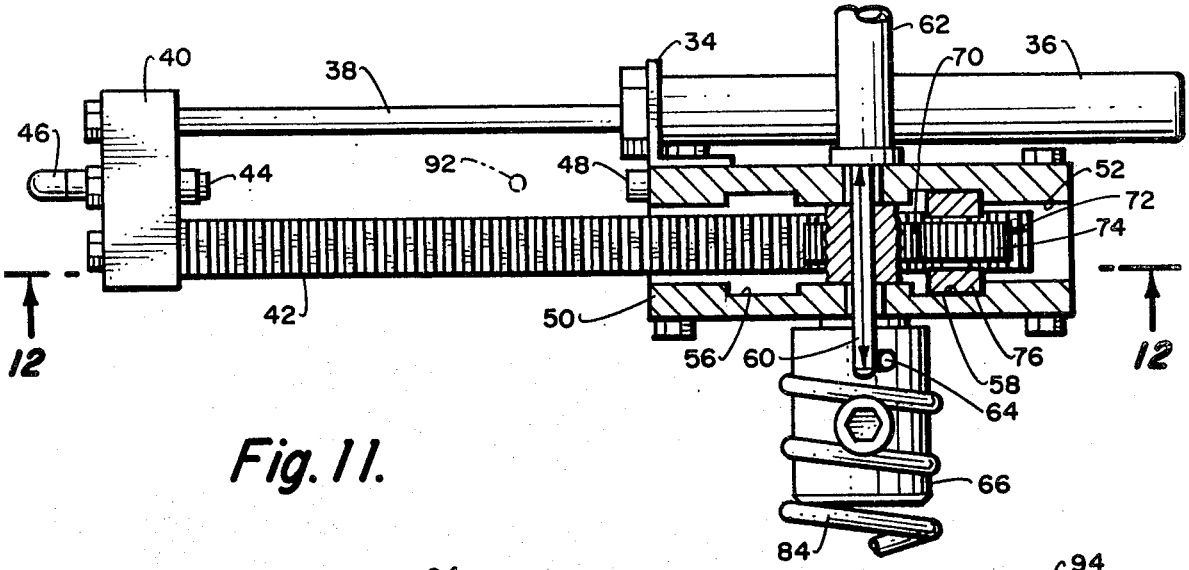
FIG. 11 is a cross-sectional view taken along line 11—11 of FIG. 10 showing in yet more detail the gear arrangement.

Extending through the housing 50 in between the compartments 56 and 58 is a rod 60. The rod 60 is movable with respect to the housing 50 by means of a piston assembly (not shown) located within actuator 62. Actuator 62 is to be operated from a valved source of pressurized fluid, again not shown. The function of the actuator 62 is to locate the rod 60 in the extended position as shown in FIG. 11 which permits the rod 60 to come into contact with protuberance 64. With the rod 60 in the retracted position, contact with the protuberance 64 is not possible.

Protuberance 64 is mounted on stub shaft 66. Stub shaft 66 is fixedly secured to connecting shaft 68. Connecting shaft 68 extends through an opening formed within the housing 50 and is fixedly secured to a driven gear 70. Driven gear 70 is mounted so as to be spaced slightly from the rack gear 42 and itself is to never be in engagement therewith.

Figure 12:
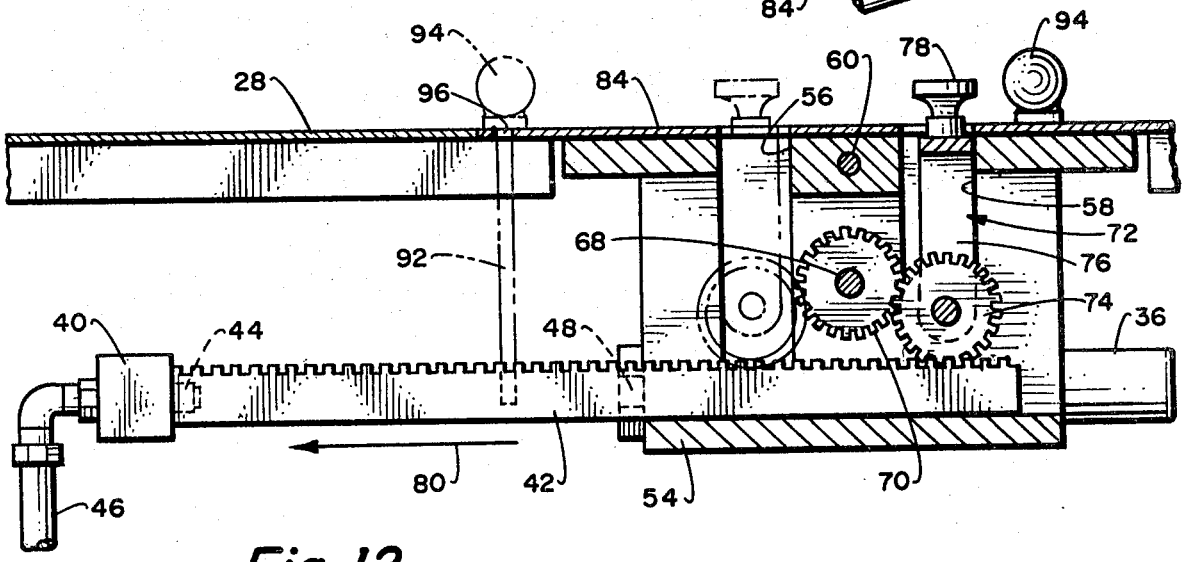
FIG. 12 is a cross-sectional view taken along line 12—12 of FIG. 11.

There is utilized an idler gear assembly 72 in the form of an idler gear 74, which is rotatably mounted on the idler gear housing 76. The idler gear assembly 72 is to be optionally locatable within either compartment 56 or compartment 58. A knob 78 is attached to the housing 76 to facilitate manual movement of the idler gear assembly 72 between the compartments 56 and 58. It is to be noted that the idler gear assembly 72 is located in a loose fitting manner within each of the compartments 56 and 58. With the idler gear assembly 72 located within one of the compartments 56 or 58, the idler gear 74 is in continuous engagement with the rack gear 42. The reason for the sloppy fit can be explained clearly in referring particularly between FIGS. 12 and 13 of the drawings. Referring particularly to FIG. 12, with the rack gear 42 moving to the left, as represented by arrow 80, the idler gear 74 is moved into engagement with driven gear 70. Therefore, the lineal movment of the rack gear 42 is translated into clockwise rotation of the idler gear 74 and counterclockwise rotation of the driven gear 70. This counterclockwise rotation of the driven gear 70 is directly transferred to stub staft in a counterclockwise direction.

With the rack gear 42 moving to the right, as represented by arrow 82 in FIG. 13, the idler gear 74 is physically displaced from the driven gear 70. Therefore, although the idler gear 74 is driven in a counterclockwise direction, there is no transfer of motion to the driven gear 70. The length of travel of the rack gear 42 is such that the stub shaft 66 will be rotated approximately one complete revolution. It is desirable that the stub shaft's rotation be precisely stopped after each and every revolution. This is achieved by the protuberance 64 coming into contact with the rod 60 at the end of each revolution. At the beginning of each rotation, the rod 60 is quickly retracted and after movement of the protuberance 50 past the rod 60, the rod 60 is then extended to be contacted by the protuberance 64 after completing a single revolution.

If it is desired to rotate the stub shaft 66 in the opposite direction, the operator only needs to physically grasp the knob 78 and remove the idler gear assembly 72 from compartment 58 and relocate such in the compartment 56. Movement of the rack gear 42 in the direction shown by arrow 80 will result in no rotation of the driven gear 70 since the idler gear 74 will be slightly spaced from the driven gear 70. However, upon the rack gear 42 being driven in the direction of arrow 82, the idler gear 74 will be moved into contact with the driven gear 70, with the driven gear 70 being driven in a clockwise direction. This direction is in reverse to the direction shown in FIG. 12.

Secured to the stub shaft 66 is a coil spring 84. The coil spring 84 forms a mass of stations located at each coil of the spring 84. The outer end 86 of the spring 84 is bent forming a short leg which extends toward the longitudinal center axis of the coil spring 84. Each station of the coil spring 84 is to support a loop of string 88 which is connected to a button 90. Each loop of string 88 is to rest at each station of the coil spring 84 by gravity.

Rotational movement of the coil spring 84 in the counterclockwise direction shown in FIG. 12 will result in the loop 88, that is located directly adjacent the outer end 86, to be dispensed or discharged from the spring 84 as the spring makes it established single revolution. As was previously mentioned, it is important that the spring 84 makes a complete revolution and then stops at the end of that revolution. In order to achieve that result, the length of the travel of the rack 42 is selected to be longer than necessary. However, the coil spring 84 will not rotate more than a single complete revolution due to protuberance 64 coming into contact with rod 60.

However, when the spring 84 is rotating in the reverse direction, it is not so important that an exact single revolution occur, but only an approximate revolution will do. When doing this reverse direction, the rod 60 of the actuator 62 is in the retracted position, which would mean that there is nothing to prevent the coil spring 84 from making a revolution and a half, or a revolution and three quarters, and so forth. This reverse direction is utilized by the operator to affect loading of the coil spring 84 with the loops 88 and the buttons 90. The operator inserts a single loop of string 88 over the end 86 and then activates the upholstery machine to rotate the coil spring 84 approximately one revolution in the reverse direction. If for some reason that reverse revolution is substantially exceeded, the operator only needs to manually turn coil spring 84 to the approximate position. The operator then proceeds to place another loop of string 88 over the end 86 and then the coil spring 84 is activated to reverse another single revolution. The procedure continues until either the desired number of loops of string 88 are located on the coil spring 84, or each station of the coil spring 84 has a single loop 88 associated therewith.

Since it was indicated earlier that the full travel of the rack 42 will generally produce more than a single complete revolution of spring 84, during the reverse movement, a pin 92 which includes an enlarged outer handle 94 is moved from the solid line storage position shown in FIG. 12 to the dotted line position also shown in FIG. 12. This places the pin 92 in the path of travel of the switch 44 toward the protuberance 48. This location has been predetermined that when the switch 94 comes into contact with the pin 92, that the rack 42 will reverse and the coil spring 84 should have rotated approximately one complete revolution in the reverse direction.

It is to be understood that the pin 92 is conducted through an opening 96 formed within the cover 28, which is to be located across the upper surface of the internal chamber 32 within the housing 30. The cover 28 is level with the upper surface of the table section 22. The purpose for the cover 28 is to provide access into the internal chamber 32.

Located directly adjacent the outer end 86 of the spring 84 is a bifurcated arm assembly which is composed of arms 100 and 102. The arm 100 includes an outer end 104 which is bent upwardly and back upon itself and inclined slightly toward arm 102. The outer end 106 of the arm 102 is similarly bent upward and upon itself and inclined toward arm 100.

Figure 1:
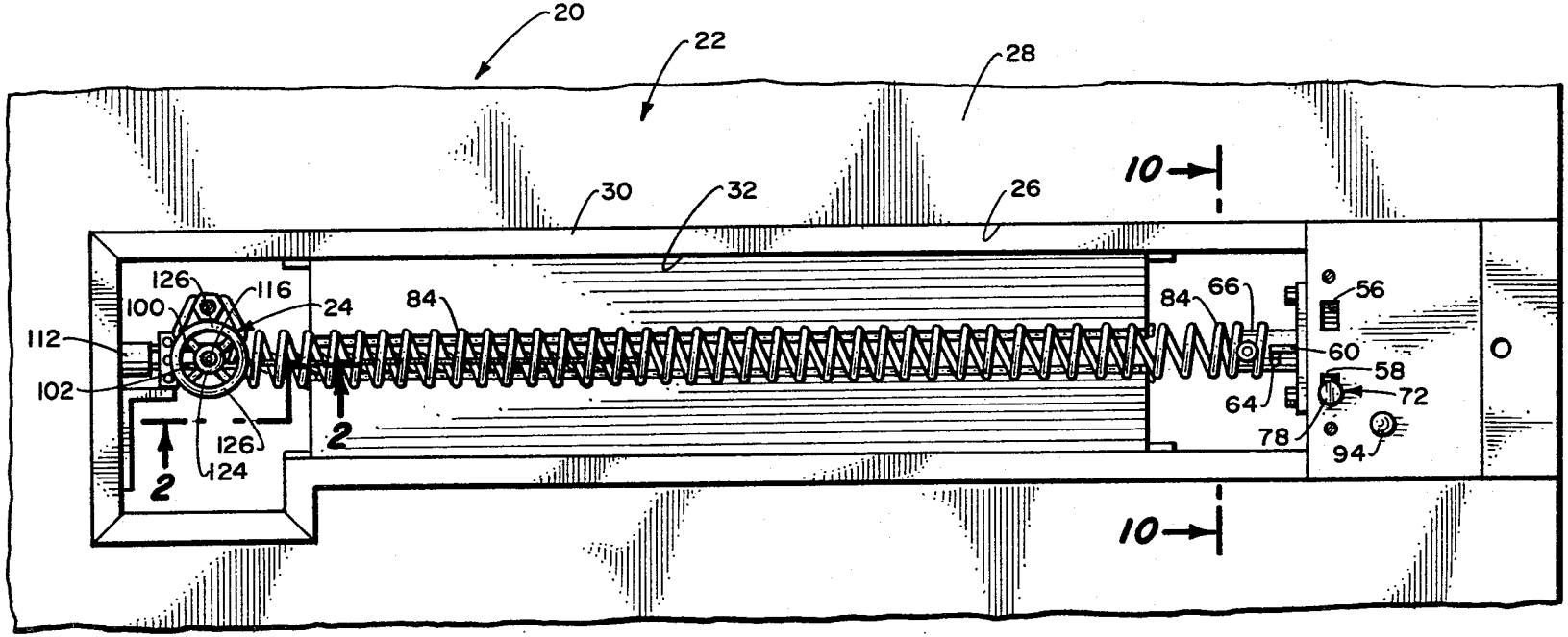
FIG. 1 is a top plan view of the present invention which is shown in combination with an upholstery machine for the tufting of a button assembly within a cushion.
Figure 9:
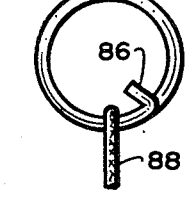
FIG. 9 is a view of the discharging end of the enlarged coil spring utilized in conjunction with the button dispensing mechanism of this invention taken along line 9—9 of FIG. 3.
Figure 8:
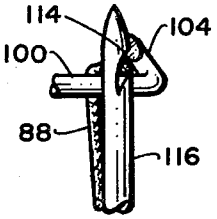
FIG. 8 is a view showing in more detail the needle utilized in conjunction with this invention taken along line 8—8 of FIG. 7.
Figure 7:
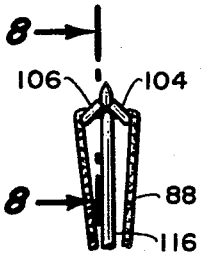
FIG. 7 is a view taken along line 7—7 of FIG. 3.
Figure 6:
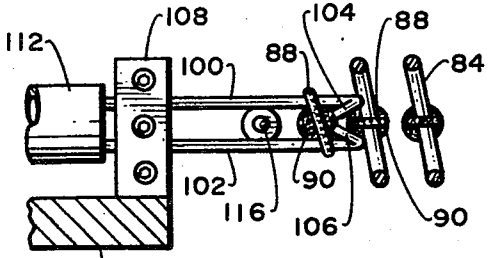
FIG. 6 is a view partly in cross-section taken along line 6—6 of FIG. 2.
Figure 5:
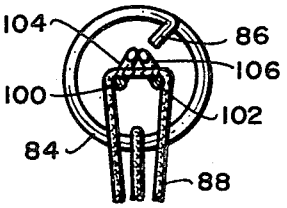
FIG. 5 is a view partly in cross-section taken along line 5—5 of FIG. 2.
Figure 2:
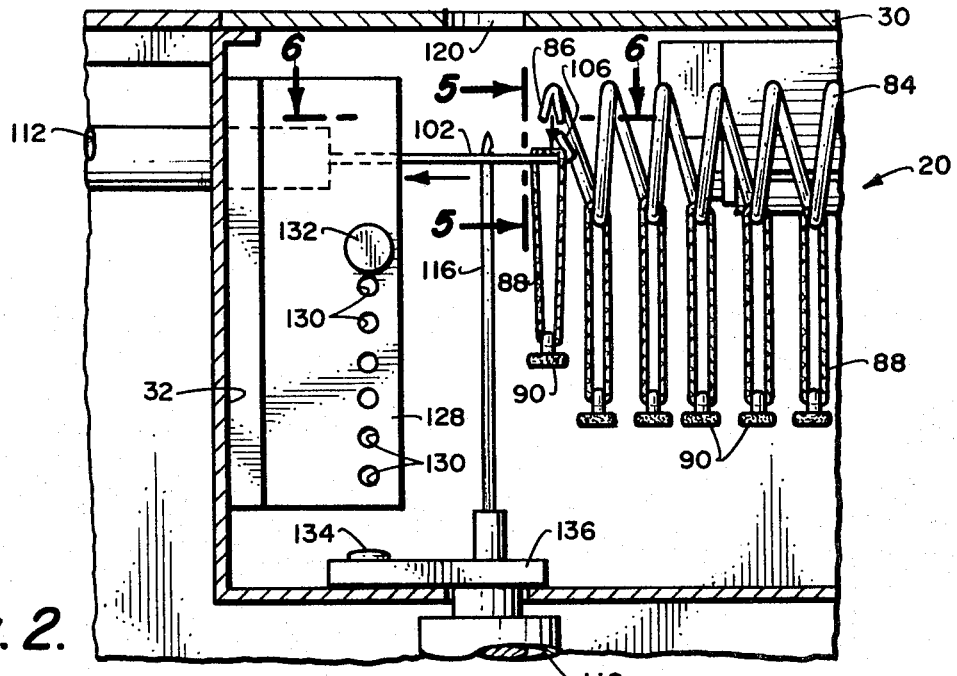
FIG. 2 is a cross-sectional view taken along line 2—2 of FIG. 1 showing in more detail the button dispensing end of the button dispensing mechanism included within the upholstery machine of this invention.
Figure 3:
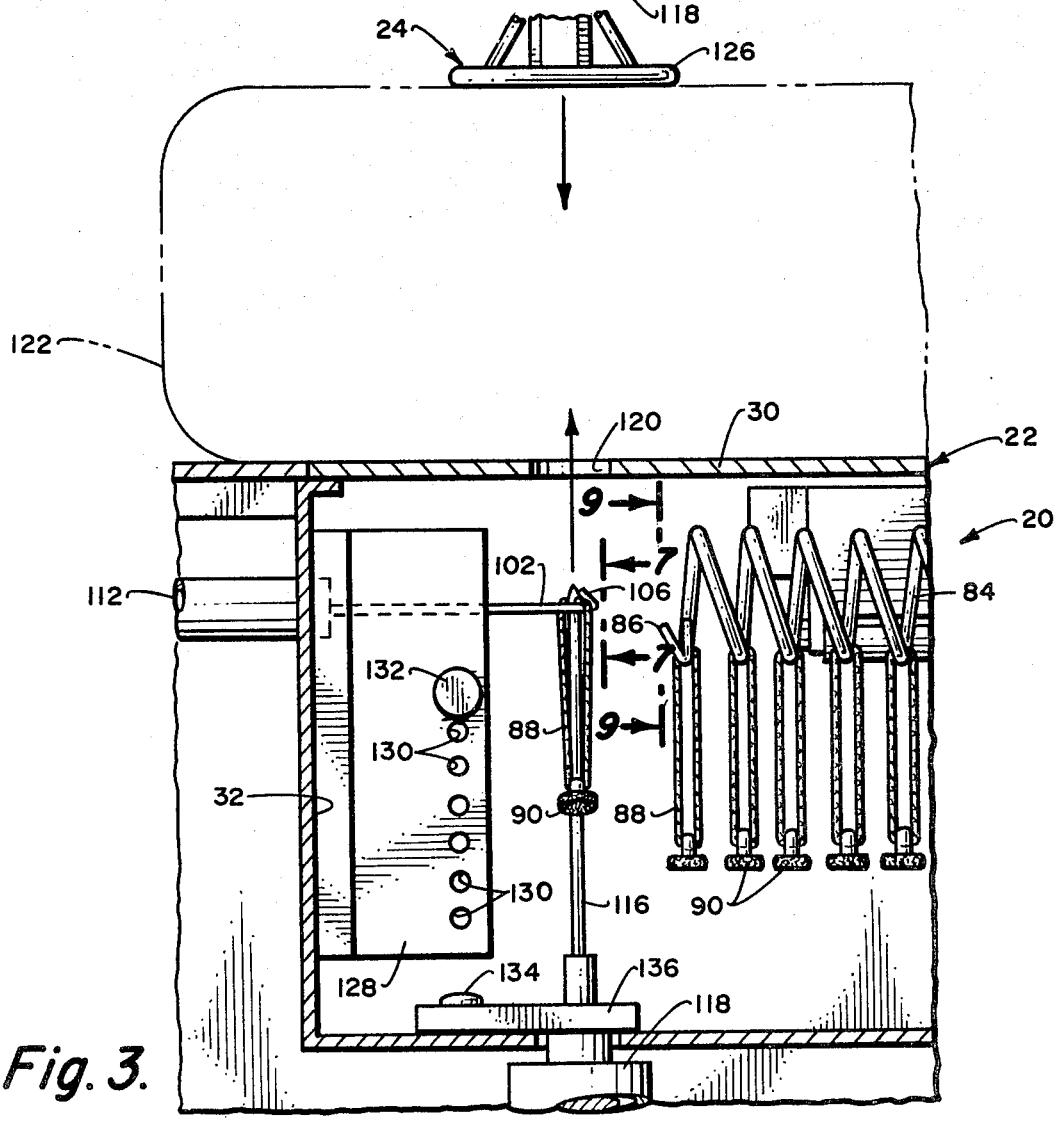
FIG. 3 is a view similar to FIG. 2 but showing a button assembly in contact with the needle and the needle about ready to penetrate a cushion.

The arms 100 and 102 are slidably mounted within a mounting block 108. The block 108 is fixedly mounted to a plate 110 which is part of the upholstery machine frame structure. The arms 100 and 102 are connected to an actuator 112. The actuator 112 is activated from a source of pressurized gas (not shown) and functions to move the arms 100 and 102 simultaneously either to the extended position shown in FIG. 2 or to a retracted position shown in FIG. 3. The extension and retraction of the arms 100 and 102 is accomplished in coordination with the rotation of the coil spring 84.

The loop of string 88 which is located directly adjacent the outer end 86 is to be deposited upon counterclockwise rotation of the spring 84 onto and across both of the arms 100 and 102 when such are in the extended position. The arms 100 and 102 are then retracted and the ends 104 and 106 prevent outward disassociation of the loop of string 88 from the arms 100 and 102. This retraction causes the portion of the string 88 extending across the arms 100 and 102 to be moved into contact with a groove 114 formed within a needle 116.

Figure 4:
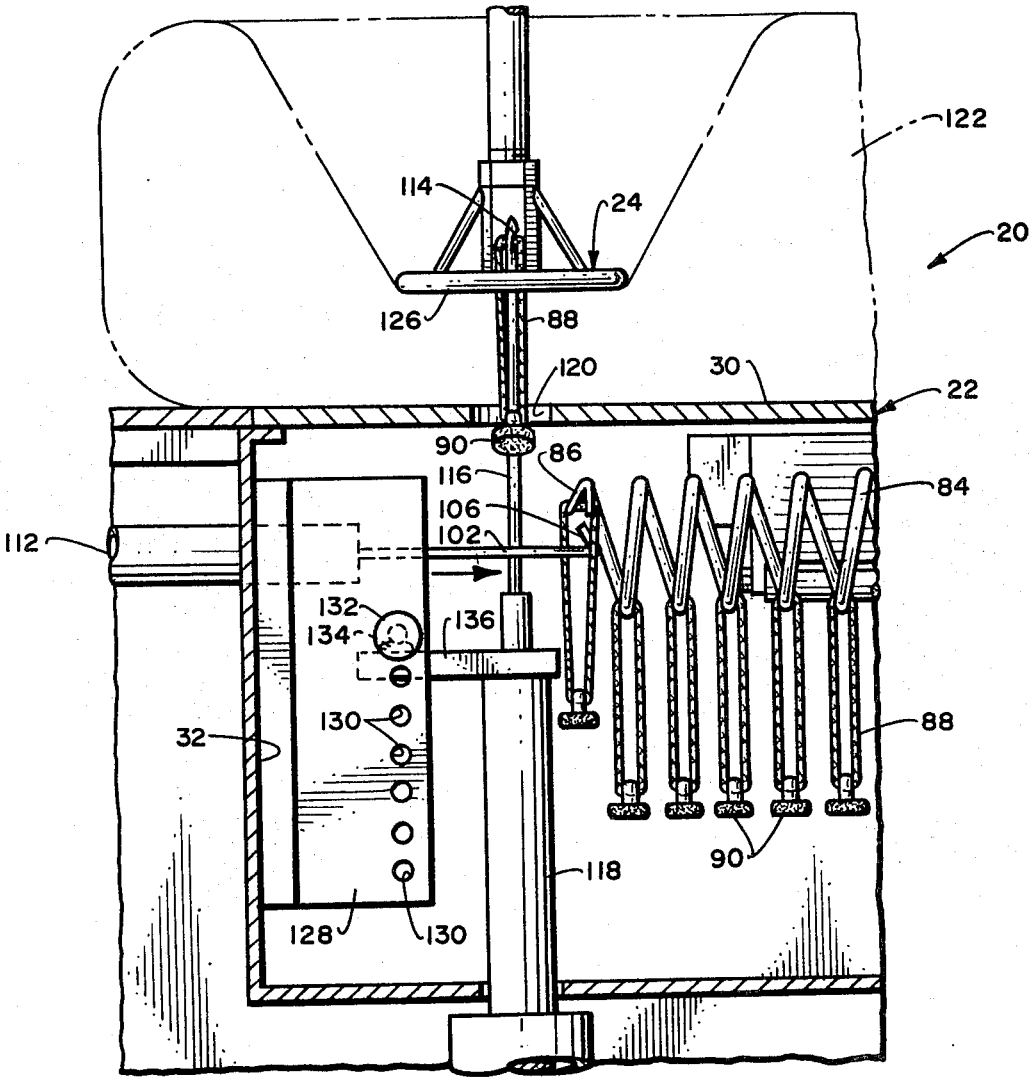
FIG. 4 is a view similar to FIG. 3, but showing the needle having penetrated the cushion and with the button assembly connected to the cushion.
Figure 10:
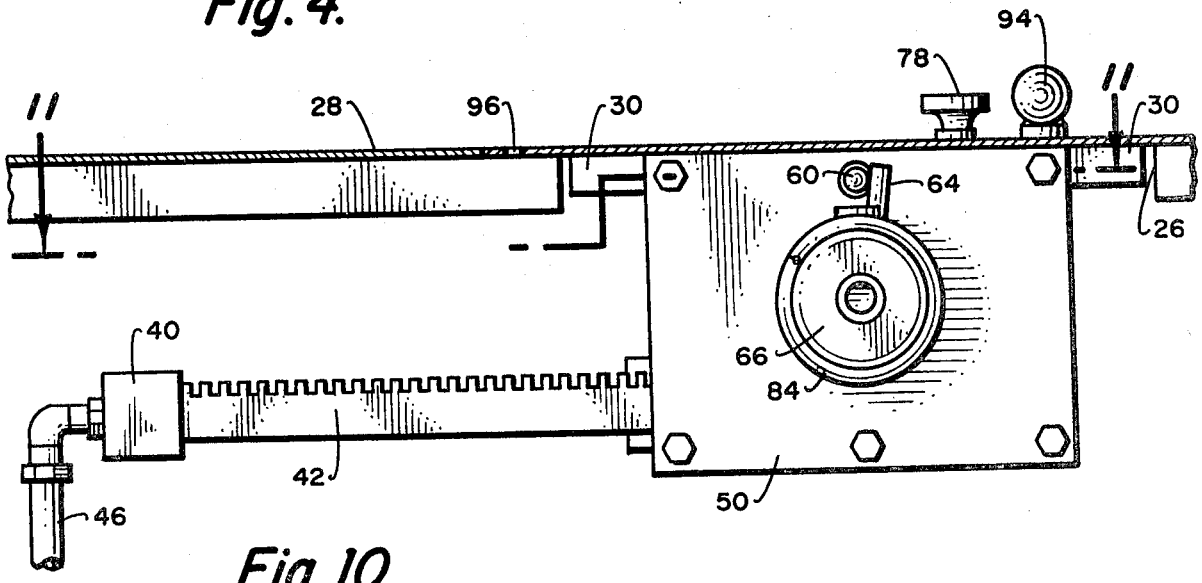
FIG. 10 is a cross-sectional view taken along line 10—10 of FIG. 1 showing in some detail a portion of the gear arrangement used to rotate the enlarged coil spring so as to discharge the button assemblies therefrom.

The needle 116 is mounted within an actuator assembly 118. The needle 116 is to be moved vertically by the actuator assembly 18 from the lower, or retracted position shown in FIGS. 2 and 3, to an upper position shown in FIG. 4. In moving to the upper position, the needle 116 is conducted through opening 120 formed within a portion of the housing 30, which takes the form of a cover plate.

The needle is then conducted through the cushion 122 until it penetrates the upper surface of the cushion 122. However, at this particular time, the compression ring assembly 24 has compressed the area of the cushion 122 directly about the needle 116. The needle 116 has been conducted through the center of internal ring 124 of the compression ring assembly 24. The internal ring 24 is concentrically disposed and rigidly connected through a spoke assembly to the external ring 126. The operation of the compression ring assembly 124 is discussed in detail in the aforementioned U.S. patent application, Ser. No. 176,460, which was referenced at the beginning of this specification and reference is to be had thereto for a more complete description of the compression ring assembly.

After the needle 116 has penetrated the top surface of the cushion 122, the needle 116 is then withdrawn, which at the same time, the arms 100 and 102 are moved again to the extended position directly adjacent the end 86 of the spring 84. During the withdrawing of the needle 116, the loop of string 88 freely falls from the groove 114 formed within the needle 116. The operator is then free to grasp a top button (not shown) and connects such to the portion of the loop 88 that protrudes from the top surface of the cushion 122. During the installing of this top button, the compression ring assembly 124 holds the cushion in the compressed state. After the top button has been so installed, the compression ring assembly 124 is retracted by an appropriate actuator assembly (not shown).

It is to be understood that if the cushion 122 is thin, then the length of the loop 88 may be quite short, such as one to two inches. In such a situation, it is not necessary and would be totally undesirable to have the needle 116 to penetrate to its maximum length, which may be five inches. If a five inch travel of the needle 116 is selected with a two inch loop, the loop 88 is going to break. Also, the loops can actually be anywhere from one half an inch to five inches in length. Therefore, it is desirable to adjust the travel of the needle 116.

This adjustment of travel is achieved through a plate 128 which includes a series of spaced-apart holes 130. The holes 130 are located in an evenly spaced-apart arrangement, such as a half an inch apart. There are actually ten in number of the holes 130 shown. However, it is considered to be within the scope of this invention that this number could be varied and also the spacing between the holes 130 could also be varied.

A single enlarged headed pin 132 is to be connectable with any one of the holes 130. The enlarged head of the pin 132 is to abutt against the exterior surface of the plate 128. It is desirable that to insure the pin 132 will remain in a set position and not be accidently dislodged from the hole 130, that the enlarged head 132 be magnetized and therefore to be magnetically held against the plate 128.

Protruding from the inner surface of the enlarged head is the body of the pin 132. This body of the pin 132 extends from the inner surface of the plate 128 a sufficient distance that it is capable of contacting pilot bleed valve 134 which is mounted on bar 136. The bar 136 is attached to the needle 116 and is movable in conjunction therewith by the actuator 118. Upon the pilot bleed valve 134 coming into contact with the pin 132, the action of the actuator 118 is reversed and the needle 116 then retracts. Therefore, the desired length of penetration of the needle 116 of the cushion 122 is preselected by the location of the pin 132 within the appropriate hole 130.

It is to be understood that the movement of the needle 116 is coordinated in respect to the movement of the arms 100 and 102 which is in turn coordinated in conjunction with the rotation of the coil spring 84, which in turn is coordinated in conjunction with the movement of the compression ring 24. This movement is in a desired sequence and occurs very rapidly.

What is claimed is:

1. In combination with an upholstery machine for the tufting of a button assembly within a cushion, said upholstery machine including a movable needle, said button assembly including a button having an attaching eyelet protruding therefrom to which is attached a string loop which extends therefrom, a button assembly feeding mechanism comprising:

an elongated housing having an elongated internal chamber, said internal chamber terminating at a fore end and an aft end, said needle being located at said fore end and being movable substantially vertically;

loop dispensing means mounted within said internal chamber, said loop dispensing means being elongated having an elongated center axis and terminating at a forward end and a rearward end, said elongated center axis being located substantially horizontal, said forward end being fee of attachment and being located directly adjacent said needle, said loop dispensing means having a plurality of spaced-apart stations, a said string loop to be located at each said station; and power means connected to said loop dispenser means, said power means being activatable to rotate said loop dispenser means, rotation of said loop dispensing means a preset amount results in discharge of a said string loop from said forward end so as to connect with said needle.

2. The combination as defined in claim 1 wherein:

said loop dispensing means comprising a coil spring.

3. The combination as defined in claim 1 wherein:

said preset amount being approximately a single three hundred and sixty degree rotation.

4. The combination as defined in claim 1 wherein:

said power means including a gear assembly, said gear assembly including a lineally movable rack gear, said rack gear engageable with an idler gear, said idler gear engaging with a driven gear, said driven gear being directly connected to said loop dispensing means.

5. The combination as defined in claim 4 wherein:

said idler gear being movable to a different position for reversal of direction of rotation of said loop dispensing means.

6. The combination as defined in claim 1 wherein:

an arm assembly located directly adjacent said needle, said arm assembly being mounted within said housing, said arm assembly being lineally movable between a first position and a second position, the said discharged string loop to be deposited on said arm assembly when in said first position, then said arm assembly is to be moved to said second position which causes said string loop to engage with engagement means formed in said needle.

7. The combination as defined in claim 6 wherein:

said engagement means comprises a slot.

8. The combination as defined in claim 1 wherein:

said upholstery machine includes positioning means to accurately locate a point on the cushion where it is desired for said needle to penetrate the cushion.

9. The combination as defined in claim 8 wherein:

said upholstery machine further includes cushion compressing means, said cushion compressing means to physically compress the cushion about the area of penetration by said needle in order to facilitate access to said string loop upon such protruding exteriorly of the cushion.

10. The combination as defined in claim 9 wherein:

said cushion compressing means comprising a ring which is movable from an upper position to a lower cushion compressing position, said ring also functioning as said positioning means.

11. The combination as defined in claim 10 wherein:

said needle passing through the substantial center of said ring.

12. A button dispensing mechanism for use within an upholstery machine, said upholstery machine including a needle, said button dispensing mechanism to singly dispense a button assembly, said button assembly comprising a button to which is attached a loop of string, said button dispensing mechanism comprising:

an elongated housing having an elongated internal chamber, said internal chamber terminating in a fore end and an aft end, said needle being located at said fore end and being movable substantially vertically;

loop dispensing means mounted within said internal chamber, said loop dispensing means being elongated having an elongated center axis and terminating at a forward end and a rearward end, said elongated center axis being located substantially horizontal, said forward end being free of attachment and being located directly adjacent said needle, said loop dispensing means having a plurality of spaced-apart stations, a said loop of string to be located at each said station; and power means connected to said loop dispensing means, said power means being activatable to rotate said loop dispensing means, rotation of said loop dispensing means a preset amount results in discharge of a said loop of string from said forward end so as to connect with said needle.

13. The button dispensing mechanism as defined in claim 12 wherein:

said loop dispensing means comprising a coil spring.

14. The button dispensing mechanism as defined in claim 12 wherein:

said preset amount being approximately a single three hundred and sixty degree rotation.

15. The button dispensing mechanism as defined in claim 12 wherein:

power means including a gear assembly, said gear assembly including a lineally movable rack gear, said rack gear engageable with an idler gear, said idler gear engaging with a driven gear, said driven gear being directly connected to said loop dispensing means.

16. The button dispensing mechanism as defined in claim 15 wherein:

said idler gear being movable to a different position for reversal of direction of rotation of said loop dispensing means.

17. The button dispensing mechanism as defined in claim 12 wherein:

an arm assembly located directly adjacent said needle, said arm assembly being mounted within said housing, said arm assembly being lineally movable between a first position and a second position the said discharged string loop to be deposited on said arm assembly when in said first position, then said arm assembly is to be moved to said second position which causes said string loop to engage with engagement means formed in said needle.

18. The button dispensing mechanism as defined in claim 17 wherein:

said engagement means comprises a slot.

19. An upholstery machine for the tufting of buttons within a cushion comprising:

a housing, said housing including a table section;

a needle mounted on said housing, said needle being movable relative to said table section between a lower position and an upper position, said needle having engagement means, said needle being shaped to have penetrated a cushion when in said upper position;

a button dispensing mechanism mounted within said table section, said button dispensing mechanism being constructed to retain a plurality of button assemblies, each said button assembly having a button body to which is connected a loop of string, said button dispensing mechanism to singly dispense a said button assembly causing its said loop of string to engage with said engagement means to said needle when said needle is in said lower position; and movement means for moving said needle to said upper position causing said loop of string to be conducted through said cushion and become taut, return movement of said needle to said lower position causes said loop of string to disengage with said engagement means leaving said loop of string in its established position.

20. The upholstery machine as defined in claim 19 wherein:

said engagement means comprises a slot formed in said needle.

21. The upholstery machine as defined in claim 19 wherein:

said plurality of said button assemblies being supported within a row within said button dispensing mechanism.

22. The upholstery machine as defined in claim 19 including:

cushion compressing means mounted on said housing, said cushion compressing means to move into contact with said cushion and compress such a predetermined amount prior to movement of said needle to said upper position.

23. The upholstery machine as defined in claim 22 wherein:

said cushion compressing means comprising a compression ring, said needle being conducted substantially through the center of said compression ring, thereby the center point of compression ring functions as a guide for the locating of a point of penetration of the cushion by said needle.

24. The upholstery machine as defined in claim 23 wherein:

said button dispensing mechanism including an enlarged coil spring, each said loop of string of each said button assembly to be located at each coil of said coil spring thereby locating a plurality of said button assemblies in a row.

25. The upholstery machine as defined in claim 24 wherein:

said coil spring to be rotated a single three hundred and sixty degree rotation to dispense a single button assembly.

26. The upholstery machine as defined in claim 25 including:

power means connected to said button dispensing mechanism, said power means being activatable to rotate said button dispensing mechanism, rotation of said button dispensing mechanism a single three hundred and sixty degree rotation results in discharge of a said single loop of string.

27. The upholstery machine as defined in claim 26 wherein:

said power means including a gear assembly, said gear assembly including a lineally movable rack gear, said rack gear engageable with an idler gear, said idler gear engaging with a driven gear, said driven gear being directly connected to said button dispensing mechanism.

28. The upholstery machine as defined in claim 27 wherein:

said idler gear being movable to a different position for reversal of direction of rotation of said button dispensing mechanism.

29. The upholstery machine as defined in claim 28 wherein:

an arm assembly located directly adjacent said needle, said arm assembly being mounted within said housing, said arm assembly being lineally movable between a first position and a second position, the said discharged button assembly to be deposited on said arm assembly when in said first position, then said arm assembly is to be moved to said second position which causes said button assembly to engage with engagement means formed in said needle.

30. The upholstery machine as defined in claim 29 wherein:

said engagement means comprises a slot.

* * * * *